United States Patent [19]

Dorleijn et al.

[11] Patent Number: 4,868,463

[45] Date of Patent: Sep. 19, 1989

[54] METHOD OF OPERATING A HIGH-PRESSURE DISCHARGE LAMP

[75] Inventors: Jan W. F. Dorleijn; Rudolf L. A. van der Heijden; Jan W. Denneman, all of Eindhoven, Netherlands

[73] Assignee: U.S. Philips Corp., New York, N.Y.

[21] Appl. No.: 677,708

[22] Filed: Dec. 4, 1984

[30] Foreign Application Priority Data

Dec. 5, 1983 [NL] Netherlands ..... 8304164

[51] Int. Cl.[4] ..... H01J 17/36

[52] U.S. Cl. ..... 315/326; 315/DIG. 2

[58] Field of Search ..... 315/326, DIG. 2

[56] References Cited

U.S. PATENT DOCUMENTS 4,002,944 1/1977 McNeill et al. ..... 315/248
4,052,636 10/1977 Strok ..... 313/631
4,170,746 10/1979 Davenport ..... 315/326
4,195,253 3/1980 Drop et al. ..... 445/6
4,527,097 7/1985 van der Heijden et al. ..... 313/631

*Primary Examiner*—Robert L. Griffin
*Assistant Examiner*—T. Salindong
*Attorney, Agent, or Firm*—Bernard Franzblau

[57] ABSTRACT

A method of and a device for the operation of a high-pressure discharger lamp provided with a discharge vessel (3) which accommodates an ionizable filling and two electrodes (4, 5), between which electrodes in the operating condition the discharge takes place. The lamp is operated from a supply source which supplies a power of periodically alternating value. According to the invention, for each power frequency $\nu_i$ (i=1,2, . . .) the relation $\nu_i \geqq 60\ \nu_1$ is satisfied, where $\nu_1$ is the lowest frequency at which in the operating condition of the lamp standing pressure waves can occur in the discharge vessel (3). Thus, it is possible to operate the lamp so as to be free from arc instabilities due to standing pressure waves.

9 Claims, 1 Drawing Sheet

METHOD OF OPERATING A HIGH-PRESSURE DISCHARGE LAMP

This invention relates to a method of operating a high-pressure discharge lamp provided with a discharge vessel which accommodates an ionizable filling and two electrodes, between which electrodes the discharge takes place in the operating condition of the lamp. The electrodes of the lamp are electrically connected in the operating condition of the lamp to a supply source which supplies a power of periodically alternating value composed of one or more power components varying sinusoidally with time and having a frequency $\nu_i$. The invention further relates to a device for operating a high-pressure discharge lamp by means of such a method.

A method of operating a high-pressure discharge lamp of the kind mentioned in the opening paragraph is known from U.S. Pat. No. 4,527,097. High-pressure discharge lamps are widely used for general illumination purposes. The field of application comprises, besides public illumination, such as road illumination, also interior illumination, for example, of sporting halls and even domestic rooms.

Discharge lamps are mostly operated by an alternating voltage source, for example, at the usual AC supply line frequency. It is also known to operate lamps at higher frequencies. With such an alternating voltage operation, the lamp consumes a power of periodically alternating value. As is known, any power of periodically alternating value can be represented by means of Fourier transformation as a series of power components varying sinusoidally with time and having different frequencies, which series can also comprise a power component of constant value.

In general, an inductive or a capacitive stabilization ballast is used for the operation of a discharge lamp. The impedance value of such a stabilization ballast depends upon the frequency at which the lamp is operated. Operation at higher frequencies is attractive because it is possible to obtain the same impedance value by the use of a smaller value of the stabilization ballast. A smaller value of the stabilization ballast has the general advantage that the power dissipated in the ballast is less due to parasitic resistance, which means an improvement in efficiency for the combination of lamp and ballast. Moreover, the dimensions are generally also smaller, which increases the possibility for integration of the stabilization ballast in the lamp.

A generally known problem in the operation of a high-pressure discharge lamp at higher frequencies is that arc instabilities may occur due to acoustic resonances. Due to the operation of the lamp at a power of alternating value, corresponding pressure variations will occur in the gaseous part of the filling of the discharge vessel. In given circumstances this may lead to the occurrence of standing pressure waves. This phenomenon is known under the designation of "acoustic resonances". Due to acoustic resonances, the discharge can be forced out of its normal position. This then leads to arc instabilities. The arc instabilities generally have an unfavourable influence on the light properties of the lamp and may even lead to extinguishment of the lamp.

In the known method of operating a high-pressure discharge lamp, the occurrence of arc instabilities due to acoustic resonances is avoided by controlling the amplitude of each separate power component as a function of the overall power consumed by the lamp. With these known functions, the frequencies at which the lamp is operated can be chosen arbitrarily. Besides the requirements of producing the desired frequencies differing from the usual AC supply frequencies, the amplitude controls impose additional requirements on the supply source to be used, which leads to more or less complex supply arrangements. The invention has for an object to provide a measure for simplifying the requirements to be imposed on the supply source.

According to the invention, a method of operating a high-pressure discharge lamp of the kind mentioned in the opening paragraph is characterized for this purpose in that for each frequency $\nu_i$ the relation $\nu_i \geqq 60\ \nu_1$ is satisfied, in which $\nu_1$ is the lowest frequency at which, in the operating condition of the lamp, a standing pressure wave can occur in the discharge vessel.

The invention imposes requirements on the supply source only with respect to the frequency at which the high-pressure discharge lamp is operated, which is a considerable simplification as compared with requirements resulting from the use of the known method. It has been found that with operation at frequencies according to the invention arc instabilities due to acoustic resonances do not noticeably influence the light and electrical properties of the lamp. For example, there is no noticeable filckering or color shift within the lamp arc.

The lowest frequency at which, in the operating condition of the lamp a standing pressure wave can occur in the discharge vessel depends upon the shape and the dimensions of the discharge vessel. Thus, it holds for an elongate discharge vessel having an average inner radius $R_i$ (in m) and an effective inner length L (in m) that, if $$\frac{L}{R_i} \geqq 1.7,\ \nu_1 = \frac{c}{2L},$$

where c represents the speed of propagation of pressure waves in the discharge vessel in m/s. And if $$\frac{L}{R_i} < 1.7,$$

it holds that $$\nu_1 = \frac{1.841\ c}{2\ \pi\ R_i}.$$

For a spherical discharge vessel having an inner radius $R_i$ (in m) it holds that $$\nu_1 = \frac{2.082\ c}{2\ \pi\ R_i},$$

The effective inner length L of the discharge vessel is the quotient of the volume enclosed by the discharge vessel and the surface area of the largest cross-section of the discharge vessel.

With respect to the speed of propagation of pressure waves c, it should be noted that this speed satisfies with a good approximation the relation:

$$c = [(c_p/c_v) \cdot (\overline{RT/M})]^{\frac{1}{2}}, \text{ in which}$$

$c_p/c_v$ is the ratio between specific heat at constant pressure and specific heat at constant volume of the gaseous part of the filling of the discharge vessel, R is the universal gas constant (8.313 J $mol^{-1}K^{-1}$), $\overline{T}$ is the average temperature of the gaseous part of the filling of the discharge vessel in K and $\overline{M}$ is the average mass per mole of the gaseous part of the filling of the discharge vessel, expressed in kg/mol.

In the case of high-pressure sodium discharge lamps, having a filling that generally contains an excess of mercury sodium amalgam along with a rare gas, in the operating condition the average mass per mole $\overline{M}$ of the gaseous part of the filling is approximately 0.15 kg/mol, the average temperature $\overline{T}$ is approximately 2600° K. and therefore the said speed of propagation is approximately 490 m/s.

In the case of a conventional high-pressure mercury discharge lamp whose filling may contain, besides mercury, a small quantity of rare gas, the average mass per mole $\overline{M}$ is of the order of 0.2 kg/mol, the average temperature $\overline{T}$ is approximately 3000° K. and the said speed of propagation is approximately 455 m/s.

For known metal halide lamps, the mercury constituent is generally determinative of the average mass per mole $\overline{M}$, and this value is then approximately 0.2 kg/mol. The average temperature $\overline{T}$ in this type of lamp is of the order of 3200° K. and therefore the speed of propagation c is of the order of 470 m/s.

Although the operation of a light source at very high frequencies is known from, for example, U.S. Pat. No. 4,002,944, this light source forms part of a microwave resonator circuit. Such light sources do not comprise electrodes and can be operated only with the aid of microwave supply sources at supply frequencies of 100 MHz and higher, such as magnetrons. The device required for such a method of operation therefore excludes the application for general illumination purposes.

In an advantageous method of operating a high-pressure discharge lamp according to the invention, it holds for each $\nu_i$ that 2 MHz$\leqq\nu_i\leqq$3 MHz. On the one hand, this is a frequency range which is suitable for the operation of all conventional high-pressure discharge lamps, while on the other hand in this frequency range the unfavourable influence of any radio-interference is a minimum.

The invention also provides a device for operating a high-pressure discharge lamp according to the invention. The device is characterized in that it is provided with means for operating the lamp at a power of periodically alternating value, which is composed of one or more power components varying sinusoidally with time and having a frequency $\nu_i$ and in that for each frequency $\nu_i$ the relation $\nu_i\geqq 60\ \nu_1$ is satisfied, in which $\nu_1$ is the lowest frequency at which, in the operating condition of the lamp, a standing pressure wave can occur in the discharge vessel. With such a device it is possible to operate lamps at suitable frequencies. The said means preferably comprise a semiconductor converter circuit.

The invention will be described more fully with reference to a drawing of a lamp suitable for operation in accordance with the invention and with a device according to the invention, and in the drawing.

Figure 1:
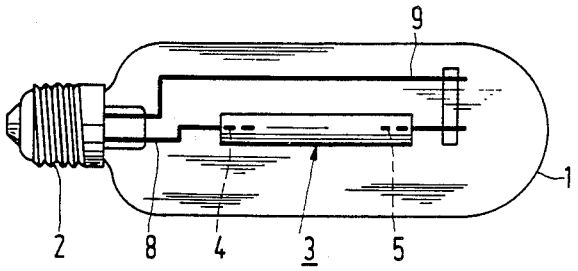
FIG. 1 shows a high-pressure discharge lamp.

In FIG. 1, reference numeral 1 denotes an outer bulb of a high-pressure discharge lamp provided with a lamp cap 2. This lamp is provided with a discharge vessel 3 which accommodates, besides a gaseous ionizable filling, two electrodes 4,5, between which, in the operating condition of the lamp, the discharge takes place. The electrode 4 is electrically connected by means of a current conductor 8 to a first connection contact of the lamp cap 2. Similarly, the electrode 5 is electrically connected through an electrical conductor 9 to a second connection contact of the lamp cap 2. In the operating condition of the lamp, the lamp is electrically connected through the connection contacts of the lamp cap 2 to a supply source.

Figure 2:
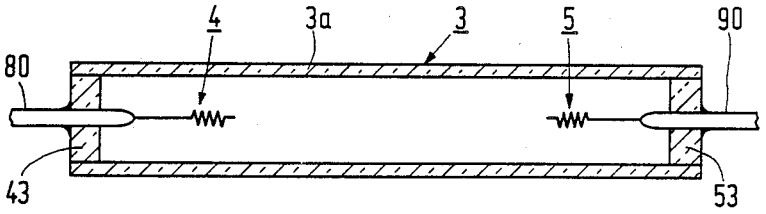
FIG. 2 shows a discharge vessel with a ceramic wall of a lamp of the kind shown in FIG. 1.

The discharge vessel 3 shown in FIG. 2 is provided with a ceramic wall 3*a*. The electrode 4 is connected to a lead-through member 80 which is connected to the current conductor 8 (FIG. 1) and is passed through a ceramic sealing member 43, to which it is connected in a gas-tight manner. In an analogous manner, the electrode 5 is connected to a lead-through member 90 which is passed through a ceramic sealing member 53 to which it is connected in a gas-tight manner.

Figure 3:
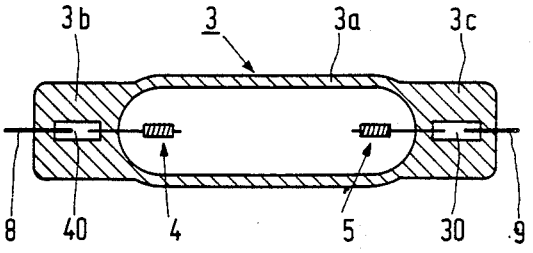
FIG. 3 shows a discharge vessel with a quartz glass wall of a lamp of the kind shown in FIG. 1.

The discharge vessel 3 as shown in FIG. 3 is provided with a quartz glass wall 3*a*. The electrode 4 is connected in a hermetically sealed pinch 3*b* to a foil 40, which in turn is connected to the current conductor 8. The electrode 5 is connected in a corresponding manner in the pinch 3*c* to a foil 30 to which the current conductor 9 is connected.

Lamps of the kind described above are operated in a device according to the invention. The table below provides data on a number of such lamps as well as the power frequency $\nu_g$, found by experiments, above which no noticeable arc instabilities due to acoustic resonances prove to occur.

| I | II | III | IV | V | VI | VII | VIII | IX | X | XI | XII | XIII |
|---|---|---|---|---|---|---|---|---|---|---|---|---|
| 1 | Na, Hg, Xe | 105 | 2.75 | | 2.33 | 139.8 | 130 | 490 | 478 | 2800 | 0.17 | 400 |
| 2 | Na, Hg, Xe | 74 | 2.4 | | 3.38 | 202.8 | 200 | 500 | 501 | 2700 | 0.15 | 150 |
| 3 | Na, Hg, Xe | 39 | 1.65 | | 5.8 | 348 | 280 | 450 | 492 | 2500 | 0.14 | 50 |
| 4 | Hg, Ar | 26 | 4 | 8.2 | | 492 | 400 | 426 | 455 | 3000 | 0.2 | 50 |
| 5 | Hg, Ar | 32 | 4 | 6.6 | | 396 | 300 | 422 | 455 | 3000 | 0.2 | 80 |
| 6 | Hg, Ar | 38 | 5 | 6 | | 360 | 350 | 456 | 470 | 3200 | 0.2 | 125 |
| 7 | Hg, Na—, Sc—, Th—salt, Ar | 5,8 | 1.7 | 39.5 | | 2370 | 1800 | 456 | 470 | 3200 | 0.2 | 35 |
| 8 | Hg, Na—, Sc—, Th—salt, Ar | 10 | 3.35 | 25 | | 1380 | 1080 | 460 | 470 | 3200 | 0.2 | 40 |

In the columns of the table the following data are given:

Column I: Lamp number.

Column II: Composition of the filling.

Column III: Effective length L of the discharge vessel in $10^{-3}$ m.

Column IV: Average inner radius $R_i$ in $10^{-3}$ m.

Column V: Value $\nu_1$ in kHz found by experiments.

Column VI: Value $\nu_1$ in kHz determined by means of the value $\nu_2$ found by experiments.
Column VII: The value 60 $\nu_1$ in kHz.
Column VIII: Value $\nu_g$ in kHz found by experiments.
Column IX: Value of c in m/s determined according to the relation $\nu_1 = c/2\ L$.
Column X: Value of c in m/s determined according to the relation $c = (c_p/c_v)^{\frac{1}{2}}(\overline{RT}/\overline{M})^{\frac{1}{2}}$
Column XI: Value of $\overline{T}$ in °K.
Column XII: Value of $\overline{M}$ in kg/mol.
Column XIII: Lamp power in W.

The lamps Nos. 1, 2 and 3 were high-pressure sodium lamps in which the construction of the discharge vessel corresponded to that of FIG. 2. Since the discharge vessel has a symmetrical construction, the lowest frequency $\nu_1$, at which in the operating condition of the lamp standing pressure waves can occur in the lamp vessel, could be found by experiments only with difficulty. The frequency $\nu_1$ is therefore derived from the next frequency $\nu_2$ at which acoustic resonances can occur according to the relation found by experiments.

$$\nu_1 = \nu_2 \cdot 0.5875.$$

It appears from the table that the frequency $\nu_g$, found by experiments, above which no arc instabilities have been found to occur, is for each lamp lower than 60. $\nu_1$.

The filling of the lamps contained an excess of sodium mercury amalgam with a mass ratio of mercury:sodium of 4.4:1. Besides, the lamp No. 1 contained xenon at a pressure of 3.3 kPa at 300° K. In the case of the lamps Nos 2 and 3, the filling also contained xenon, but at a pressure of 530 kPa at 300° K.

The lamps Nos. 4, 5, 6, 7 and 8 all were equipped with a quartz glass discharge vessel as shown in FIG. 3. In the case of the lamps Nos. 4, 5 and 6, the filling contained mercury and argon at a filling pressure of 4.7 kPa. The mass of mercury varied from 11 mg with the lamp No. 4, 15 mg with the lamp No. 5 to 23 mg with the lamp No. 6 and had evaporated completely in the operating condition.

Experiments rendered it quite possible to determine the frequency $\nu_1$. Also in these lamps, the measured frequency $\nu_g$ proves to be lower than 60 $\nu_1$. With the lamps Nos. 7 and 8, the filling contained, besides mercury and argon, a small quantity of halide salt containing Na, Sc and Th. With the lamp No. 7, the filling had the following mass ratio:

Hg 0.6 mg
halide salt 0.75 mg
Ar 530 kPa (300° K.).

For the lamp No. 8, the filling consisted of 2.3 mg of Hg and 2.4 mg of halide salt. The argon filling pressure was $10^4$ Pa. It also holds for these lamps that during operation with a power at a frequency of more than 60 $\nu_1$ no arc instabilities due to acoustic resonances occur because the cut-off frequency, $\nu_g$, determined by experiments, proves to lie below the value 60 $\nu_1$.

What is claimed is:

1. A method of operating a high-pressure discharge lamp provided with a discharge vessel which accommodates an ionizable filling and two electrodes, between which electrodes a discharge takes place in the operating condition of the lamp, which comprises electrically connected the electrodes of the lamp, in the operating condition of the lamp to a supply source which supplies a power of periodically alternating value composed of one or more power components varying sinusoidally with time and having a frequency $\nu_i$, wherein for each frequency $\nu_i$ the relation $\nu_i \geqq 60\ \nu_1$ is satisfied, in which $\nu_1$ is the lowest frequency at which, in the operating condition of the lamp, a standing pressure wave can occur in the discharge vessel.

2. A method of operating a high-pressure discharge lamp as claimed in claim 1, characterized in that for each $\nu_i$ it holds that $$2\ \text{MHz} \leqq \nu_i \leqq 3\ \text{MHz}.$$

3. A device for operating a high-pressure discharge lamp provided with a discharge vessel which accommodates an ionizable filling and two electrodes, between which electrodes, in the operating condition of the lamp, a discharge takes place, characterized in that the device comprises means for operating the lamp at a power of periodically alternating value which is composed of one or more power components varing sinusoidally with time and having a frequency $\nu_i$ and that for each frequency $\nu_i$ the relation $\nu_i \geqq 60\ \nu_1$ is satisfied, in which $\nu_1$ is the lowest frequency at which, in the operating condition of the lamp, a standing pressure wave can occur in the discharge vessel.

4. A method of operating a high-pressure discharge lamp having a discharge vessel which accommodates two spaced electrodes along with an ionizable gas filling so that an electric discharge occurs between the electrodes in the operating condition of the lamp, the method comprising: applying to said electrodes a source of electric energy of periodically varying power comprising one or more power components sinusoidally varying with time and having frequency components $\nu_i$, wherein for each power frequency $\nu_i$ the relation $\nu_i \geqq 60\ \nu_1$ is satisfied, wherein $\nu_1$ is the lowest frequency at which acoustic resonance can occur in the discharge vessel of an operating lamp.

5. A method as claimed in claim 4 wherein each frequency component $\nu_i$ satisfies the relation $2\ \text{MHz} \leqq \nu_i \leqq 3\ \text{MHz}$.

6. A device as claimed in claim 3 comprising an elongate discharge vessel having an average inner radius $R_i$ and an effective inner length L, wherein $$\frac{L}{R_i} \geqq 1.7 \text{ and } \nu_1 = \frac{c}{2L},$$

where c is the propagation speed of pressure waves in the discharge vessel in m/s.

7. A method as claimed in claim 4 wherein the lamp comprises a high-pressure sodium discharge lamp having a propagation speed (c) of pressure waves in the discharge vessel of approximately 490 m/s.

8. A device as claimed in claim 3 wherein the lamp comprises a high-pressure mercury discharge lamp including a small quantity of a rare gas in addition to a mercury filling, wnd wherein the lamp has a propagation speed (c) of approximately 455 m/s.

9. A method as claimed in claim 4 wherein the lamp comprises a high-pressure metal halide lamp having a propagation speed (c) of pressure waves in the discharge vessel of approximately 470 m/s.

* * * * *